United States Patent [19]

Takahata

[11] Patent Number: 5,059,493

[45] Date of Patent: Oct. 22, 1991

[54] HEAT AND CORROSION RESISTANT PLATING

[75] Inventor: Seiya Takahata, Mishima, Japan

[73] Assignee: Usui Kokusai Sangyo Kaisha, Ltd., Shizuoka, Japan

[21] Appl. No.: 498,240

[22] Filed: Mar. 23, 1990

[30] Foreign Application Priority Data

Mar. 28, 1989 [JP] Japan ..... 1-75869

[51] Int. Cl.[5] ..... B32B 15/00; B32B 1/00

[52] U.S. Cl. ..... 428/658; 428/679; 428/926; 428/936

[58] Field of Search ..... 428/659, 671, 674, 676, 428/632, 658, 679, 677, 926, 936; 148/264, 265, 266, 267

[56] References Cited

U.S. PATENT DOCUMENTS 2,918,722 12/1959 Kenmore ..... 428/677
4,190,504 2/1980 Usui ..... 428/632
4,500,610 2/1985 Gunn et al. .
4,849,301 7/1989 Kanasashi .
4,853,297 8/1989 Takahashi et al. .

FOREIGN PATENT DOCUMENTS 60-165387 8/1985 Japan ..... 428/679

*Primary Examiner*—R. Dean
*Assistant Examiner*—Robert R. Koehler
*Attorney, Agent, or Firm*—Armstrong, Nikaido, Marmelstein, Kubovcik & Murray

[57] ABSTRACT

A multilayer plating showing high corrosion resistance even at elevated temperatures includes a first or undercoat layer formed from cobalt, nickel or a cobalt or nickel alloy on the surface to be protected, and a second or overcoat layer formed on the first layer from zinc or a zinc alloy. The second layer may further be chromated.

8 Claims, 1 Drawing Sheet

HEAT AND CORROSION RESISTANT PLATING

BACKGROUND OF THE INVENTION

1. Field of the Invention

This invention relates to a heat and corrosion resistant multilayer plating used to protect the surfaces of plates, pipes, joints, clamps, bolts, nuts, and other parts used in motor vehicles, machines and apparatus, and made mainly of iron and steel.

2. Description of the Prior Art

It has been usual to plate the surfaces of plates, pipes, joints, clamps, bolts, nuts, and other parts used in motor vehicles, machines or apparatus and made mainly of iron and steel, with zinc or a zinc alloy to form a zinc-based plating for protecting them against corrosion. Alloys, such as of zinc and nickel and of zinc and tin, have beem used to form a plating of higher corrosion resistance. It has often been the case that a chromate film is formed on any such plating.

All of these platings have, however, been found satisfactory for corrosion resistance only at low ambient temperatures. In an environment having an elevated temperature, for example, in the engine room of an automobile in which a temperature of about 200° C. prevails, the plating lowers its sacrificial corrosive action due to the oxidation of zinc, or its corrosion resistance due to the destruction of the chromate film.

SUMMARY OF THE INVENTION

It is, therefore, an object of this invention to provide an improved plating which exhibits a desired level of high resistance not only to corrosion, but also to heat.

This object is attained by a multilayer plating comprising an undercoat layer of cobalt or a cobalt alloy, or of nickel or a nickel alloy, and an overcoat layer of zinc or a zinc alloy, or one further including a chromate film formed on the overcoat layer.

The plating of this invention exhibits a high level of corrosion resistance even at elevated temperatures. Its heat and corrosion resistance can be brought to any desired level if the thickness of its undercoat layer is appropriately varied.

Other features and advantages of this invention will be apparent from the following description and the accompanying drawing.

DETAILED DESCRIPTION OF THE INVENTION

Figure 1:
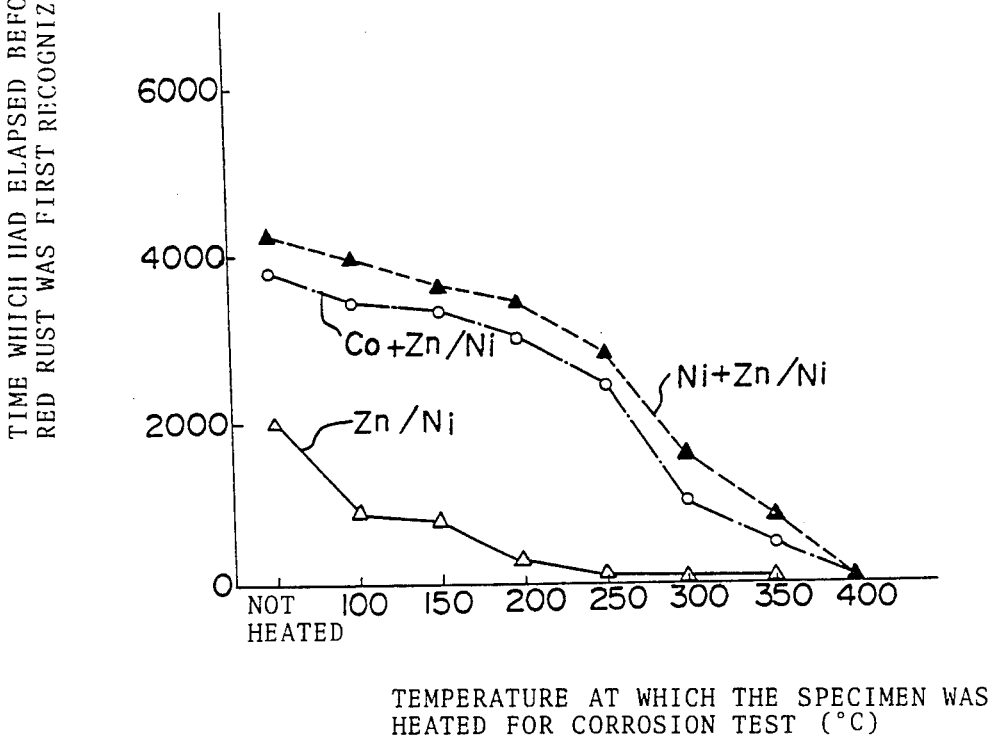
FIG. 1 is a graph showing the results of corrosion resistance tests conducted under heat in some examples that will hereinafter be described.

The plating of this invention is applicable to plates, pipes, joints, clamps, bolts, nuts, or other mechanial parts made mainly of iron and steel. It is particularly effective for application to relatively thin pipes having an outside diameter of, say, about 10 mm and used to make, for example, a pipeline for a hydraulic fluid or fuel in an automobile. The pipes to which it is effectively applicable include a lap welded steel pipe having a weld layer of copper on its exposed surface or between its overlapping surfaces.

The plating of this invention includes an undercoat layer formed from either cobalt or an alloy thereof, such as an alloy of cobalt and nickel, or nickel or an alloy thereof, such as an alloy of nickel and phosphorus, or of nickel and boron. The undercoat layer preferably has a thickness of 0.2 to 10 microns. No undercoat layer having a thickness which is smaller than 0.2 micron is expected to cover effectively the surface to be protected, and achieve any substantially improved heat or corrosion resistance. A layer having a thickness exceeding 10 microns is likely to peel off or crack when the material which has been plated is, for example, pressed or bent. Moreover, no such layer can be expected to provide any appreciably increased corrosion resistance for its thickness.

An undercoat layer of cobalt having a thickness of five microns can be formed by, for example, using a bath containing 150 g of cobalt chloride and 50 g of boric acid per liter and having a pH of 5, a bath temperature of 60° C., a current density of 5 A/dm$^2$ and a residence time of six minutes. A layer of an alloy of cobalt and nickel having a thickness of about five microns can be formed, for example, in a bath containing 140 g of nickel sulfate, 110 g of cobalt sulfate, 30 g of boric acid and 15 g of potassium chloride per liter and having a pH of 4.5, using a bath temperature of 45° C., a current density of 2 A/dm$^2$ and a residence time of five minutes.

An undercoat layer of nickel is preferably formed by employing a Watts bath.

A layer of an alloy of nickel and phosphorus having a thickness of about five microns can, for example, be formed in a bath of a solution prepared by diluting to five volumes the product of Japan Kanizen Co., Ltd. sold as "SUMER S-780", using a bath temperature of 90° C. and a residence time of 15 minutes. A layer of an alloy of nickel and boron having a thickness of about three microns can, for example, be formed in a bath of the product of C. Uemura & Co., Ltd. sold as "BEL-801", using a bath temperature of 65° C. and a residence time of 30 minutes.

The plating of this invention further comprises an overcoat layer of zinc or a zinc alloy having a thickness of at least three microns. A layer of zinc can be formed by electrolyzing a solution of zinc cyanide or sulfate as known in the art. A layer of an alloy of zinc and nickel having a thickness of about five microns can, for example, be formed in a bath for the ZIN-LOY process which has been developed by Ebara-Udylite Co., Ltd., using a bath temperature of 35° C., a current density of 3 A/dm$^2$ and a residence time of six minutes. A layer of an alloy of zinc and tin having a thickness of about six microns can be formed, for example, in a bath of the solution manufactured by Dipsol Chemical Co., Ltd. and sold as SZ-240, using a bath temperature of 25° C., a current density of 2 A/dm$^2$ and a residence time of 10 minutes.

The plating of this invention may further include a chromate film formed on the overcoat layer. An appropriate chromate film, can, for example, be formed by dipping the material to be coated in a commercially available solution for chromating a plating of an alloy of zinc and nickel (e.g. ZN-80YMU sold by Ebara-Udylite Co., Ltd.), or one for chromating a zinc plating (e.g. Z-493 sold by Dipsol Chemical Co., Ltd.).

The multilayer plating of this invention as hereinabove described exhibits excellent corrosion resistance even if it may be exposed to an elevated temperature, or subjected to a bending force. The high corrosion resistance of the plating at an elevated temperature is apparently due to the fact that the undercoat layer is not deteriorated by heat and, even if the overcoat layer may be deteriorated by heat, it still retains its function as a sacrificial anode for the iron or steel which has been plated, and remains sufficiently effective for preventing any corrosion through pinholes or other small defects in the undercoat layer. The heat and corrosion resistance of the plating can be adjusted as desired, if the thickness of the undercoat layer is appropriately altered.

The invention will now be described more specifically with reference to several examples.

EXAMPLE 1

[1] Manufacture of a thin pipe (seam welded steel pipe)

A seam welded steel pipe having an outside diameter of 8 mm, a wall thickness of 0.7 mm and a length of 380 mm was manufactured from steel designated as STPG-38 by a customary process.

[2] Formation of an undercoat layer (cobalt)

An undercoat layer of cobalt having a thickness of three microns was formed on the surface of the pipe by electroplating in a bath containing 150 g of cobalt chloride and 50 g of boric acid, per liter, and having a pH of 5, using a bath temperature of 60° C., a current density of 5 A/dm$^2$ and a residence time of three minutes.

[3] Formation of an overcoat layer (an alloy of zinc and nickel)

An overcoat layer of an alloy of zinc and nickel having a thickness of five microns was formed on the undercoat layer by electroplating in a bath for the ZINLOY process of Ebara-Udylite Co., Ltd., using a bath temperature of 35° C., a current density of 3 A/dm2 and a residence time of six minutes.

[4] Formation of a chromate film

The pipe was dipped in a bath containing 50 ml of ZN-80YMU (product of Ebara-Udylite Co., Ltd.) per liter and having a temperature of 50° C. and was left in it for 20 seconds, whereby a chromate film was formed on the overcoat layer, thereby yielding a multilayer plating.

[5] Heat and corrosion resistance test (salt spray test)

(a) Preparation of a specimen

The pipe was formed into a stick-shaped specimen having a 250 mm long strainght portion and a bent end portion having a radius of curvature of 25 mm. A cap made of a synthetic resin was placed over each of the open ends of the specimen to prevent any rusting from growing at the exposed steel. The specimen was degreased by a clean and soft piece of cloth impregnated with ethyl alcohol, and was allowed to dry.

(b) Preparation of a test solution

A test solution of salt having the following characteristics was prepared from the following materials:

(1) Sodium chloride: Grade 1 of JIS K 8150 (sodium chloride), or a reagent classified as a Special Grade;
(2) Water: Distilled water having a resistance of at least $50\times10^4$ ohm cm;
(3) Concentration: 5.0% when the solution was prepared;
(4) Specific gravity: 1.0295 at 35° C. when the solution was prepared;
(5) ph: 6.5 to 7.2 at 35° C. when the solution was prepared;
(6) Adjustment of pH: A solution obtained by diluting Grade 1 of JIS k 8576 (sodium hydroxide) in distilled water was used to adjust the pH of the test solution.

The specific gravity was measured by a calibrated hydrometer having a graduation of 0.0005, and the pH by a pH meter including a glass electrode.

(c) Test method

The salt spray test was conducted by using a salt spray tester conforming to Rule 5.1 of JASO 7370 (Method of Testing Brake Tubes), which is a standard established by the Society of Automotive Engineers of Japan, and following the salt spray test procedures specified in Annex 1 to the Rule. Each specimen was placed in a test vessel at right angles to the direction in which the test solution would be sprayed, and at an angle of 30° to the vertical plane. In case two or more specimens were tested together, they were spaced apart from one another by a distance of at least 5 mm and so supported as not to contact anything other than a supporting rod made of glass or a synthetic resin, so that any mist might be allowed to drop freely.

(d) Maintenance of the appropriate conditions

Inspection was made at regular intervals of time to ensure that the following conditions be maintained throughout the test:

(1) Concentration and specific gravity of the solution:
Concentration: 5±1%;
Specific gravity: 1.0223 to 1.0364 at 35° C.;
(2) pH of the solution: 6.5 to 7.2 at 35° C.;
(3) Spray pressure: 1.0±0.025 kg/cm$^2$;
(4) Test vessel temperature: 35≡1° C.;
(5) Temperature of test solution reservoir: 35±1° C.;
(6) Air saturator temperature: 47±1° C.;
(7) Spray rate: 1.0 to 2.0 ml/80 cm$^2$/h.;
(8) Mode of spraying: Continuous for the specified length of time.

When it was necessary to interrupt the test, the specimen was removed from the test vessel, washed carefully with clean water, and allowed to dry for storage.

(e) Surface inspection and recording

Every 24 hours, the specimen was washed with clean water and inspected for any white or red rust clearly recognizable with naked eyes under an illumination of at least 300 lux. A record was made of the time which had elapsed before any such rust could be recognized for the first time.

The inspection was made of only the upper half portion of the surface of the specimen in the test vessel, and each end portion of the specimen up to a distance of 5 mm from the cap was also excluded from the inspection. When there were two or more specimens having the same specification, the specimen on which rust was recognized earlier than the rest was taken as representing all of the specimens in quality.

[6] Test results

The salt spray test conforming to JIS Z 2371 and JASO M 104-86was conducted on several specimens that had been heated for 24 hours at different temperatures, respectively, and another specimen that had not been heated at all, as shown in FIG. 1. A record was made of the time which had elapsed before red rust was first recognized. The results are shown in FIG. 1.

EXAMPLE 2

[1] Manufacture of thin pipe (seam welded steel pipe)

EXAMPLE 1 was repeated for the manufacture of seam welded steel pipes.

[2] Formation of an undercoat layer (nickel)

An undercoat layer of nickel having a thickness of three microns was formed on each pipe by electroplating in a Watts bath, using a bath temperature of 55° C., a current density of 3 A/dm$^2$ and a residence time of six minutes.

([3] Formation of an overcoat layer (an alloy of zinc and nickel)

The procedure [3] in EXAMPLE 1 was repeated for forming an overcoat layer of an alloy of zinc and nickel on the undercoat layer.

[4] Formation of a chromate film

The procedure [4] in EXAMPLE 1 was repeated for forming a chromate film on the overcoat layer to thereby complete a multilayer plating.

[5] Heat and corrosion resistance test

The procedures [5] and [6] in EXAMPLE 1 were repeated for the heat and corrosion resistance test of each plated specimen. The results are shown in FIG. 1.

COMPARATIVE EXAMPLE 1

[1] Manufacture of thin pipes

The procedure [1] in EXAMPLE 1 was repeated for the manufacture of seam welded steel pipes.

[2] Formation of a layer of an alloy of zinc and nickel

The procedure [3] in EXAMPLE 1 was followed to form a layer of an alloy of zinc and nickel having a thickness of 8 microns on each pipe.

[3] Formation of a chromate film

The procedure [4] in EXAMPLE 1 was repeated for forming a chromate film on the alloy layer.

[4] Heat and corrosion resistance test

The procedures [5] and [6] in EXAMPLE 1 were repeated for the heat and corrosion resistance test of each plated specimen. The results are shown in FIG. 1.

The results shown in FIG. 1 confirm the superiority of the multilayer plating according to this invention. Although all of the specimens according to EXAMPLES 1 and 2 of this invention and COMPARATIVE EXAMPLE 1 which had been heated at 100° C. were lower in corrosion resistance than those which had not been heated, the reduction in corrosion resistance of the specimens according to this invention was smaller, as thermal diffusion had occurred only partly between the undercoat and overcoat layers. Although the comparative specimens which had been heated at 200° C. and 250° C. failed to show any practically satisfactory corrosion resistance, the specimens according to this invention which had been heated at the same temperatures exhibited satisfactorily high levels of corrosion resistance which were even higher than that of the comparative specimen which had not been heated at all.

EXAMPLE 3

[1] Manufacture of thin pipes

The procedure [1] in EXAMPLE 1 was repeated for the manufacture of seam welded steel pipes.

[2] Formation of an undercoat layer (an alloy of cobalt and nickel)

An undercoat layer of an alloy of cobalt and nickel (65Co-35Ni) having a thickness of five microns was formed on each pipe by electroplating in a bath containing 140 g of nickel sulfate, 110 g of cobalt sulfate, 30 g of boric acid and 15 g of potassium chloride, per liter, and having a pH of 4.5, using a bath temperature of 45° C., a current density of 2 A/dm$^2$ and a residence time of 15 minutes.

[3] Formation of an overcoat layer (zinc)

An overcoat layer of zinc having a thickness of eight microns was formed on the undercoat layer by electroplating in a bath containing 28 g of zinc oxide, 50 g of sodium cyanide and 80 g of sodium hydroxide, per liter, using a bath temperature of 25° C., a current density of 3 A/dm$^2$ and a residence time of 15 minutes.

[4] Formation of a chromate film

Each pipe was dipped in a solution containing 10 ml of Z-493 (product of Dipsol Chemical Co., Ltd.) per liter and having a temperature of 25° C. and was left in it for 15 seconds, whereby a chromate film was formed on the overcoat layer to thereby yield a multilayer plating on the pipe.

[5] Heat and corrosion resistance test

Figure 2:
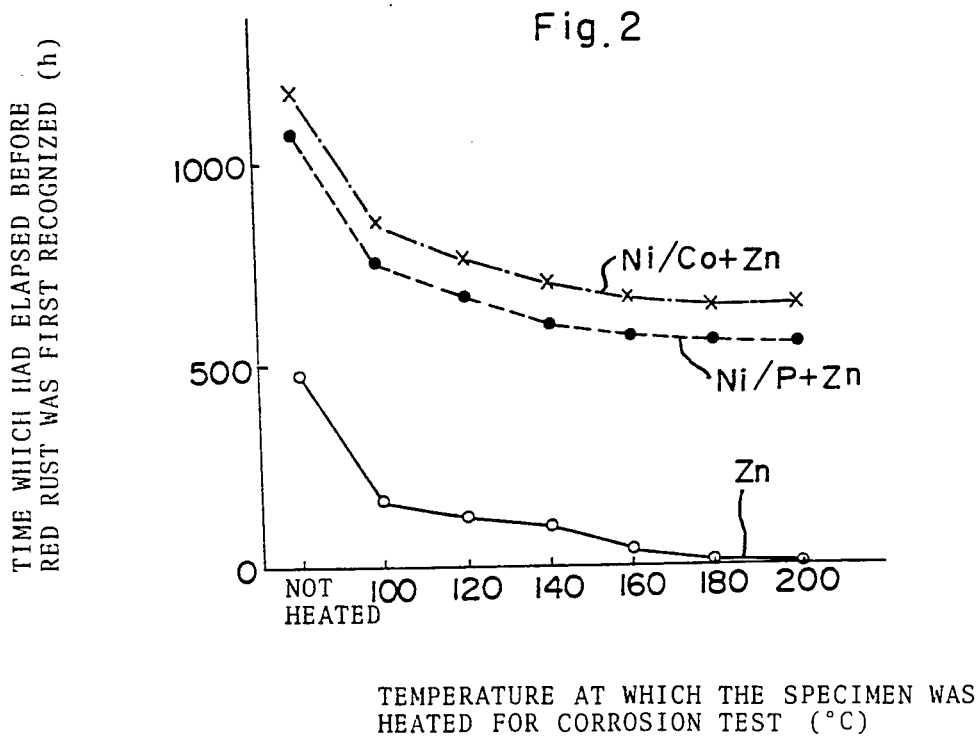
FIG. 2 is a graph similar to FIG. 1, but showing the results of other examples.

The procedures [5] and [6] in EXAMPLE 1 were repeated for the heat and corrosion resistance test of each specimen. The results are shown in FIG. 2.

EXAMPLE 4

[1] Manufacture of thin pipes

The Procedure [1] in EXAMPLE 1 was repeated for the manufacture of seam welded steel pipes.

[2] Formation of an undercoat layer (an alloy of nickel and phosphorus)

An undercoat layer of an alloy of nickel and phosphorus having a thickness of five microns was formed on each pipe by dipping in a bath of a solution obtained by diluting SUMER S-780 (product of Japan Kanizen Co., Ltd.) to five volumes, using a bath temperature of 90° C. and a residence time of 15 minutes.

[3] Formation of an overcoat layer (zinc)

The procedure [3] in EXAMPLE 3 was repeated for forming an overcoat layer of zinc having a thickness of eight microns on the undercoat layer.

[4] Formation of a chromate film

The procedure [4] in EXAMPLE 3 was repeated for forming a chromate film on the overcoat layer, whereby a multilayer plating was formed on each pipe.

[5] Heat and corrosion resistance test

The procedures [5] and [6] in EXAMPLE 1 were repeated for the heat and corrosion resistance test of each plated specimen. The results are shown in FIG. 2.

COMPARATIVE EXAMPLE 2

[1] Manufacture of thin pipes

The procedure [1] in EXAMPLE 1 was repeated for the manufacture of seam welded steel pipes.

[2] Formation of a zinc layer

The procedure [3] in EXAMPLE 3 was followed to form a layer of zinc having a thickness of 13 microns on each pipe.

[3] Formation of a chromate film

The procedure [4] in EXAMPLE 3 was followed to form a chromate film on the zinc layer.

[4] Heat and corrosion resistance test

The procedures [5] and [6] in EXAMPLE 1 were followed for the heat and corrosion resistance test of each plated specimen. The results are shown in FIG. 2.

As is obvious from FIG. 2, the specimens which had been heated at 100° C. were lower in corrosion resistance than those which had not been heated, and a similar pattern of reduction in corrosion resistance was observed in all of the specimens according to this invention and COMPARATIVE EXAMPLE 2. This was apparently due to the fact that the chromate film covering the zinc layer was likely to lose water of crystallization under the influence of heat. The heating of the specimens at higher temperatures up to 200° C., however, revealed a significant difference in the lowering of corrosion resistance between the specimens according to this invention and the comparative specimens. This was apparently due to the fact that, while all of the comparative specimens each coated only with a chromated zinc layer had their plating so deteriorated by heat as to greatly lower its function as a sacrificial anode, the multilayer plating on each specimen according to this invention, which includes an undercoat alloy layer underlying a zinc layer, did not substantially lower its corrosion resistance at the elevated temperatures, since the zinc layer remained sufficiently effective as a sacrificial anode to prevent any corrosion through any small defect in the undercoat layer, as hereinbefore stated.

EXAMPLE 5

[1] Manufacture of thin pipes (lap welded steel pipes)

Lap welded steel pipes were manufactured from a material designated as SPCC and having a surface coated with a weld layer of copper having a thickness of about three microns. The pipes were of the same dimensions as those which had been prepared in EXAMPLE 1 (including a wall thickness of 0.7 mm).

[2] Formation of an undercoat layer (cobalt)

[3] Formation of an overcoat layer (an alloy of zinc and nickel)

[4] Formation of a chromate film

The procedures [2] to [4] in EXAMPLE 1 were repeated for forming an undercoat layer, an overcoat layer and a chromate film, respectively, whereby a multilayer plating was formed on each pipe.

[5] Heat and corrosion resistance test

The procedures [5] and [6] in EXAMPLE 1 were repeated for the heat and corrosion resistance test of each plated specimen. A period of 3800 hours had elapsed before red rust was first recognized on the specimen which had not been heated at all, and a period of 3000 hours, on the specimen which had been heated at 200° C. for 24 hours.

EXAMPLE 6

[1] Manufacture of thin pipes (lap welded steel pipes)

The procedure [1] in EXAMPLE 5 was repeated for the manufacture of lap welded steel pipes.

[2] Formation of an undercoat layer (an alloy of cobalt and nickel)

[3] Formation of an overcoat layer (zinc)

[4] Formation of a chromate film

The procedures [2] to [4] in EXAMPLE 3 were repeated for forming an undercoat layer, an overcoat layer and a chromate film, respectively, whereby a multilayer plating was formed on each pipe.

[5] Heat and corrosion resistance test

The procedures [5] and [6] in EXAMPLE 1 were repeated for the heat and corrosion resistance test of each plated specimen. A period of 1100 hours had elapsed before red rust was first recognized on the specimen which had not been heated at all, and a period of 550 hours on the specimen which had been heated at 200° C. for 24 hours.

EXAMPLE 7

[1] Manufacture of thin pipes (seam welded steel pipes)

The procedure [1] in EXAMPLE 1 was repeated for the manufacture of seam welded steel pipes.

[2] Formation of an undercoat layer (nickel)

Nickel layers having different thicknesses were formed on different pipes, respectively, by following the procedure [2] employed in EXAMPLE 2, but using different residence times. The different thicknesses of the undercoat layers of nickel are shown in TABLE 1.

[3] Formation of an overcoat layer (an alloy of zinc and nickel)

The procedure [3] employed in EXAMPLE 2 was repeated for forming an overcoat layer of an alloy of zinc and nickel on the undercoat layer on each pipe, whereby a multilayer plating was formed on each pipe.

[4] Heat and corrosion resistance test

The procedures [5] and [6] employed in EXAMPLE 1 were repeated for the heat and corrosion resistance test of each plated specimen. The results are shown in TABLE 1.

TABLE 1

| Thickness of nickel layer (um) | Time which had elapsed before red rust was first recognize (h) | | | | | |
|---|---|---|---|---|---|---|
| | Straight portion | | | | Bent portion | |
| | Not heated | 150° C. | 200° C. | 250° C. | Not heated | 200° C. |
| 0.1 | 1800 | 1008 | 480 | 360 | 1320 | 360 |
| 0.2 | 2400 | 2280 | 2016 | 1512 | 2016 | 1512 |
| 0.5 | 2880 | 2640 | 2520 | 2016 | 2160 | 1512 |
| 1.0 | 3120 | 3000 | 3000 | 2520 | 2160 | 1800 |
| 2.5 | 3240 | 3120 | 3000 | 2520 | 2880 | 2400 |
| 5.0 | 4200 | 3960 | 3600 | 3120 | 3600 | 3120 |
| 7.5 | 4200 | 4080 | 4080 | 3240 | 2880 | 2280 |
| 10.0 | 4080 | 3960 | 3600 | 3240 | 2016 | 1512 |
| 15.0 | 3600 | 3240 | 3120 | 2880 | 1008 | 840 |

What is claimed is:

1. A heat and corrosion resistant plating comprising:

a first layer formed on a base surface from a material selected from the group consisting of cobalt, nickel, a cobalt alloy and a nickel alloy, said nickel alloy is selected from the group consisting of an alloy of nickel and phosphorous and an alloy of nickel and boron; and a second layer formed on said first layer from a material selected from the group consisting of zinc and a zinc alloy.

2. A plating as set forth in claim 1, wherein said cobalt alloy is an alloy of cobalt and nickel.

3. A plating as set forth in any one of claims 1 or 2, wherein said first layer has a thickness of 0.2 to 10 microns.

4. A plating as set forth in claim 3, wherein said second layer has a thickness of at least three microns.

5. A plating as set forth in claim 1, further including a chromate film formed on said second layer.

6. A plating as set forth in claim 5, wherein said cobalt alloy is an alloy of cobalt and nickel.

7. A plating as set forth in any one of claims 5 or 6, wherein said first layer has a thickness of 0.2 to 10 microns.

8. A plating as set forth in claim 7, wherein said second layer has a thickness of at least three microns.

* * * * *